United States Patent [19]

Hummel et al.

[11] 3,943,700

[45] Mar. 16, 1976

[54] LARGE-SIZED CLOCKWORK WITH AN ELECTRICALLY DRIVEN STRIKING TRAIN

[75] Inventors: Herbert Hummel, Niedereschach; Hansrichard Schulz, Villingen-Schwenningen, both of Germany

[73] Assignee: Erhard Jauch, Villingen-Schenningen, Germany

[22] Filed: Apr. 3, 1974

[21] Appl. No.: 457,722

[30] Foreign Application Priority Data

Apr. 4, 1973 Germany ..... 2316833

[52] U.S. Cl. ..... 58/38 A; 58/8

[51] Int. Cl.[2] ..... G04C 21/00

[58] Field of Search ..... 58/8–15, 38

[56] References Cited

UNITED STATES PATENTS

| | | | |
|---|---|---|---|
| 853,119 | 5/1907 | Rodgers | 58/19 R |
| 1,164,511 | 12/1915 | Hardisty | 58/38 |
| 1,322,216 | 11/1919 | Adams et al. | 58/38 |
| 1,398,972 | 12/1921 | Little | 58/38 |
| 3,702,529 | 11/1972 | Zeter et al. | 58/9 |
| 3,778,997 | 12/1973 | Jauch | 58/13 |

FOREIGN PATENTS OR APPLICATIONS

| | | | |
|---|---|---|---|
| 1,237,959 | 3/1967 | Germany | 58/13 |

*Primary Examiner*—Lawrence R. Franklin
*Attorney, Agent, or Firm*—Haseltine, Lake & Waters

[57] ABSTRACT

A large-sized clockwork comprising movement, a striking train, an electrical drive mechanism for the striking train, and a control section for the striking train which includes a first control element for actuation of the striking train and a second control element for limiting the striking period thereof. The two control elements include control portions which are each adapted to be sensed by a substantially reaction-free electrical sensing device, which is superordinated to the striking train drive device. Depending upon the choice of the sensing means, the control section has only negligibly small power requirements. Consequently, no restrictions which would be dictated by the control section, now exist in the selection of the movement system.

9 Claims, 11 Drawing Figures

II
III
VI

LARGE-SIZED CLOCKWORK WITH AN ELECTRICALLY DRIVEN STRIKING TRAIN

FIELD OF THE INVENTION

The present invention relates to a large clockwork comprising a movement, a striking train, an electrical drive mechanism for the striking train, and a control section for the striking train which includes a first control element for actuation of the striking train and a second control element for limiting the striking period thereof.

DISCUSSION OF THE PRIOR ART

From the prior U.S. Pat. No. 3,778,997, there has become known a large clockwork of this type, of which the control section for the striking train is formed of mechanical components. In this instance, a star wheel having three similar cam teeth and one elevated cam tooth is driven by the movement so as to close at each quarter hour, through the intermediary of a lever mechanism, a contact which in turn causes a gear motor serving as a striking train drive device to run until, after the quarter chime has been completed, the contact is again opened by means of a quarter wheel mounted on the striking train shaft.

The prior art mechanical striking train control system is generally complicated and expensive, not only due to the large number and required precision of fabrication of its mechanical components, but additionally due to its complicated assembly. The control system also has relatively high electric drive power supply requirements, so as to necessitate a relatively large battery. The high power supply requirements of the mechanical control section imposes a load not only on the striking train but also on the movement. For this reason it has, for example, not been hitherto possible to utilize the electromagnetic oscillation systems which have been proven to be successful in clocks without striking trains.

SUMMARY OF THE INVENTION

It is therefor an object of the present invention to provide a control section for the striking train of a clockwork of the type mentioned, and which has the lowest possible energy requirements.

According to the invention, this object is achieved in that the two control elements include control portions which are each adapted to be sensed by a substantially reaction-free electrical sensing device, which is superordinated to the striking train drive device.

This solution, on the one hand, possesses the advantage that relatively complicated mechanical components which require a large amount of work during assembly, may be made more economical. On the other hand, a particular advantage lies in the fact that, depending upon the choice of the sensing means, the control section has only negligibly small power requirements. Consequently, no restrictions which would be dictated by the control section, now exist in the selection of the movement system.

In an advantageous further embodiment of the invention, the sensing device associated with the control elements may consist of sets of contact springs which, if an amplifier is incorporated in front of the drive device of the striking train, need to switch only minimum amounts of control currents. Such sets of contact springs can operate with contact forces which are in the range of only a few pounds, and impose only negligible loads upon the movement. Preferably, in this case, the control elements are constructed as cam cyclinders with control cams. In an advantageous development of this embodiment, at least one of the sets of contact springs is constituted of pairs of contact springs each having two contact springs of different length, each with one sensing section, which are raised consecutively by the same associated cam during rotation of the cam cylinder, so that the relevant contact is closed when the longer spring sensing section descends along the steep rear flank of the cam, and the shorter spring sensing section rises along the flat front flank of the cam. This inventive solution offers a reliable and assured contacting action without making special demands on the precision of adjustment of the two contact springs.

The contact sets may be arranged on the circuit of the striking train drive device. Preferably, they are placed in the circuit of an amplifier stage which is superordinated to the striking train drive device. By virtue of use of the amplifier stage, only a minimum control current flows through the contact spring sets, amounting to approximately one-hundredth of the current flowing through the gear motor, so that the contact spring sets may be constructed to be correspondingly thin, and comparatively reaction-free in operation.

In a further advantageous embodiment of the invention, total freedom of reaction towards the movement can be achieved, in that the control elements are provided with two partially mutually overlapping control wheels rotatably mounted on parallel axes and being provided with perforations, slits or recesses, while the movement paths are mutually staggered in a stepwise manner in the radial direction, so that the perforations, on the one hand, and the slits and recesses, on the other hand, at least partially overlap one another in pairs. By means of this arrangement, it is rendered possible for the sensing device to consist, in each case, of pairs of inductances or condensor plates, or possibly of pairs of light sources and light receivers, which are respectively associated with an overlap position of the paths of movement of the perforations, slits or recesses, which are separated by the control wheels and adapted to be coupled through the mutually overlapping perforations, slits or recesses. In that instance, however, in the case of employing battery-driven clockworks, the inductive or capacitive sensing is preferred due to the considerably lower required power. When inductive sensing devices are used, the control wheels preferably consist of aluminum, whereas in the case of capacitive sensing, they may consist of any suitable material.

In one advantageous variant of this embodiment, the pairs of inductances or condenser plates are parts of an LC-oscillator which contains a band path filter formed with the assistance of the inductances or condenser plates, and a transistor operated in the base circuit and capacitively coupled thereto. The LC-oscillator preferably is tuned so that it can only oscillate in the case of direct coupling between the pairs of inductances or condenser plates — i.e. only when there is an overlap in the mutually associated perforations and slits or the recess in the region of an associated pair.

When light sources and light receivers are used, the light receivers are conveniently associated with a direct voltage amplifier which delivers an output signal to the drive device only as long as one of the light receivers receives light from the light sources during an overlapping of the perforations and slits or recesses of the control wheels. This is similarly only the case when a direct passage of light through both control wheels is possible.

In a convenient further development of the invention, the oscillator is followed by a direct current amplifier, to which the striking train drive device is connected. Advantageously located between the oscillator and the direct current amplifier there may be a rectifier stage, which preferably contains two diodes which are connected in voltage-doubling circuit.

In a preferred embodiment, the direct current amplifier contains three transistors, while the collectors of the first two transistors are each connected to the base of the next transistor, and the conductivity type of consecutive transistors is complementary in each case. Through this means, the current absorption of the three transistors is extremely low in the rest condition, which would not be possible if transistors of the same conductivity type were to be used.

For large clockworks of the type described, it is generally desired to be able to automatically switch off the striking train at night. According to a further proposal of the invention this is rendered possible, in that a regulating wheel, which is driven by the movement at one revolution per 24 hours, is provided with mountable riders by means of which the striking train drive device can be switched off automatically through a contact during a period determined by the riders.

As an advantageous variant of this embodiment, the contact includes a sensing section sliding on the circumference of the regulating wheel, which is deflectable by the riders projecting outwards from the circumference of the regulating wheel, so that the contact is opened, therefore, during rotation of the regulating wheel by means of the movement, the striking train is automatically switched off by opening of the contact at intervals determined by the riders. This mechanism can easily be installed in any large clockwork of this type, and without appreciable additional financial outlay.

A particularly simple embodiment of the night-time switching off device is characterized in that the regulating wheel is provided on a part of its circumference, with notches each having a stepped indentation, and wherein the riders are mountable upon each notch in two positions mutually rotated through 180°, in which a stop positioned on the inside of each rider is in contact with respectively the higher or lower part of the stepped indentation. In this case, the width of each rider preferably corresponds to the rotation of the regulating wheel which is performed during the period of 1 hour. The riders are conveniently maintained in both positions on the regulating wheel by a lug engaging each into an indentation formed on the lateral surfaces of the regulating wheel. By simply pulling out and reversing the riders through 180°, it is thus possible, in simple manner, to determine the hours during which the striking train is required to be inoperative. The riders associated with the said hours are brought by the reversal into a position projecting somewhat out of the circumference of the regulating wheel, in which they ensure the opening of the contact through the sensing section.

In a simple manner, it is additionally possible to provide a lever adjustable by hand, through the operation of which the contact may be arbitrarily opened or closed.

In all embodiments of the invention, the assembly of the large clockwork may, according to a further proposal of the invention, be facilitated in that the cam cylinders, and/or gear wheels, and/or cam wheels of the striking train each include a projection extending inwardly out of their bore, and which is anchored against rotation in a longitudinal groove of the associated shaft.

Cam cylinders, gear wheels and cam wheels may be slid integrally in rotation onto the associated shaft having a longitudinal groove, designated a profile shaft, and merely require fastening in the longitudinal direction. Any aligning and fastening by tensioning with secrews or the like, such as has been necessary for the hitherto custormary mode of assembly of cam cylinders, gear wheels and cam wheels of this type, is thereby eliminated.

BRIEF DESCRIPTION OF THE DRAWINGS

Exemplary embodiments of the invention will now be explained in further detail with reference to the figures of the accompanying drawings, wherein.

DETAILED DESCRIPTION

Figures 1, 2, 3, 4, 5:
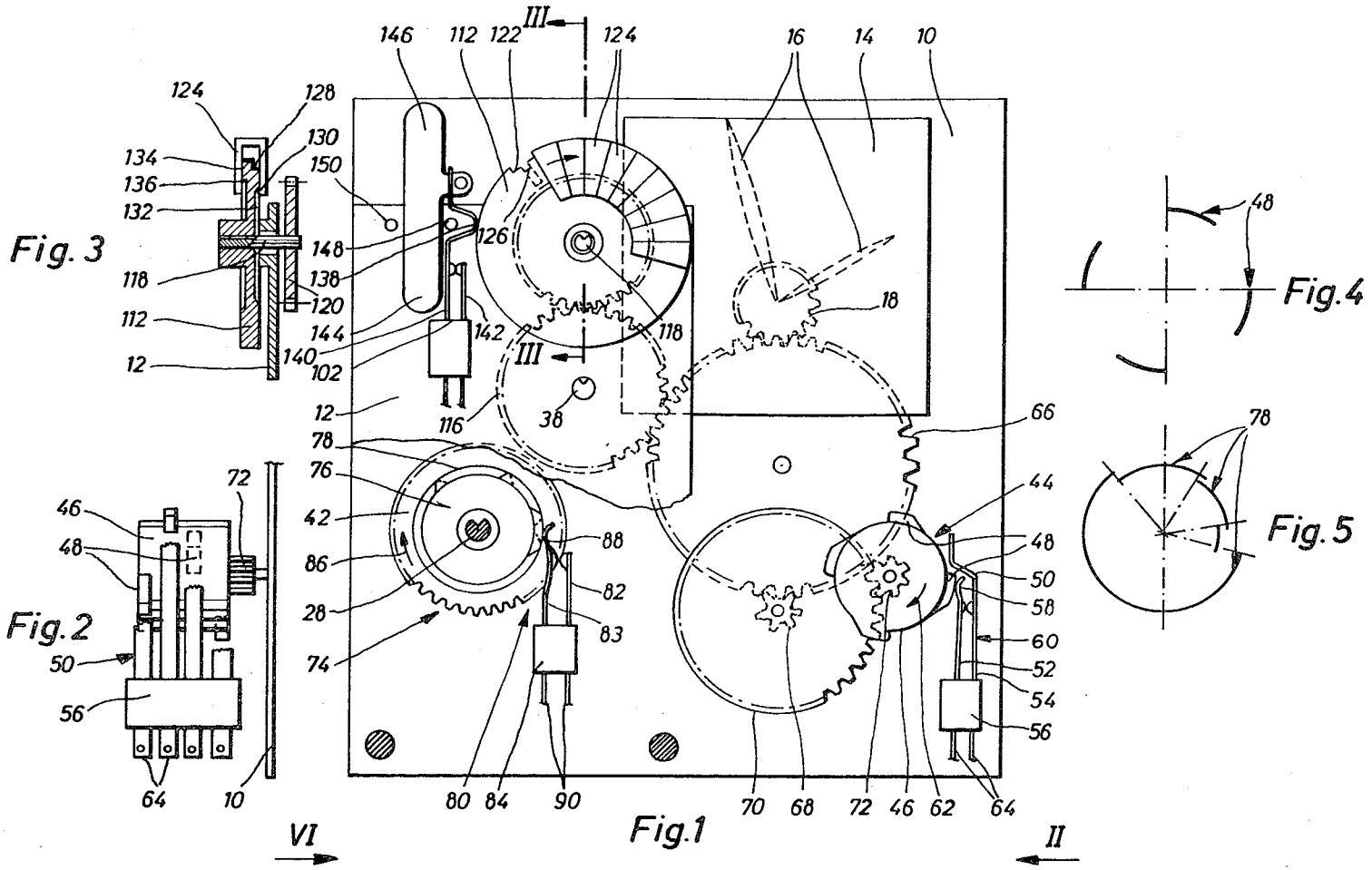
FIG. 1 shows a schematic elevation of a large clockwork according to the invention, the striking train of which is controllable by a control section equipped with contacts, and in which individual parts are shown fragmented or sectioned for greater clarity.
FIG. 2 shows a partial elevational view of the clockwork illustrated in FIG. 1 in the direction of the arrow II in FIG. 1.
FIG. 3 shows a partial section taken long the line III—III in FIG. 1.
FIGS. 4 and 5 each show a graphic representation of the cam arrangement of the two cylinders illustrated in FIG. 1, viewed in the direction of the cylinder axis.

The first embodiment of the large clockwork according to the invention, illustrated in FIGS. 1 to 6, includes a main plate 10, visible in rear elevation in FIG. 1, and a rear plate 12 partially fragmented in FIG. 1. The clockwork further includes a movement 14, a hand mechanism 16 driven by the movement, and a drive wheel 18 mounted on the hour tube 17 of the hand mechanism.

Similarly, between the plates 10 and 12, there is arranged the striking train 20 of the clock, while the hammer levers 22 engaging into the cam wheels 26 are supported rotatably upon an axis 24, and whilst the cam wheels 26 actuating the hammers are mounted upon a shaft 28 supported rotatably in the plates 10 and 12. As may be seen from FIG. 1, the shaft 28 exhibits a longitudinal groove into which there engages a projection which protrudes inwardly from the bore of each cam wheel 26. Through this means, the assembly of the cam wheels 26 upon the shaft 28 is rendered extremely simple, since they only require anchoring against axial displacement by suitable snap rings or the like. Furthermore, this mode of fastening allows for the possibility of subsequently exchanging individual cam wheels for others whereby, for example, the melody played by the striking train may be varied at will. This mode of supporting the cam wheels 26 on the shaft 28 may also be selected for all of the other cam wheels, cam cylinders and gear wheels of the clockwork on the various shafts of the latter, where they are required to be mutually fixed, so that the exchange of individual wheels or gears which become worn becomes extremely simple.

For the striking train 20 there is provided an electric gear motor 30, which drives the cam wheels 26 of the striking train 20 through the intermediary of a worm gear 32 and a worm wheel 34 in mesh therewith, an intermediate gear 40 loosely mounted for rotation on a shaft 38 which is supported between the plates 10 and 12, and a gear wheel 42 non-rotatably mounted on the shaft 28. Through this means, the hammers (not shown) of the striking train are actuated in a manner known per se.

The time for switching on the gear motor 30 at each quarter hour is determined by a first control element 44 which is consituted by a control cylinder 46 with four cams 48 spaced about the periphery thereof and radially staggered with repect to each other along the axial direction of the cylinder, and a contact spring set 50 associated with the cam 48. Associated with each cam 48 is a pair of contact springs 52, 54, which are secured, in each instance, in a spring block 56. The one spring 52 of each pair of springs has a short sensing section 58, whilst the other spring 54 in each case has a longer sensing section 60. During rotation of the cam cylinder 46 in the direction of the arrow 62, the sensing sections 60 and 58 consecutively come into contact with the respectively associated cam 48. Then, moving initially from the open rest position of each pair of contact springs 52, 54, the longer sensing section 60 of the contact spring 54, and subsequently the shorter sensing section 58 of the contact spring 52, come into contact with the associated cam 48, without the contact being closed. Through this intermediary, differences in adjustment between the individual pairs of contact springs are compensated. Whilst the cam 48 moves onwards, the sensing section 60 first moves down from the steep rear flank thereof, whilst during this time the shorter sensing section 58 still rises along the flatter front flank of the cam 48. Consequently, the closing sequence of the pair of contact springs 52, 54 will occur during an extremely short angular movement of the cam cylinder 46, and therefore with precise chronological accuracy. Theoretically, the contact closure could also occur abruptly — e.g. by a sensing section 60 bent at right angles towards the cam 48. This, however, would not admit for a manual adjustment of the hand in a counter-clockwise direction, as explained hereinbelow.

Figure 7:
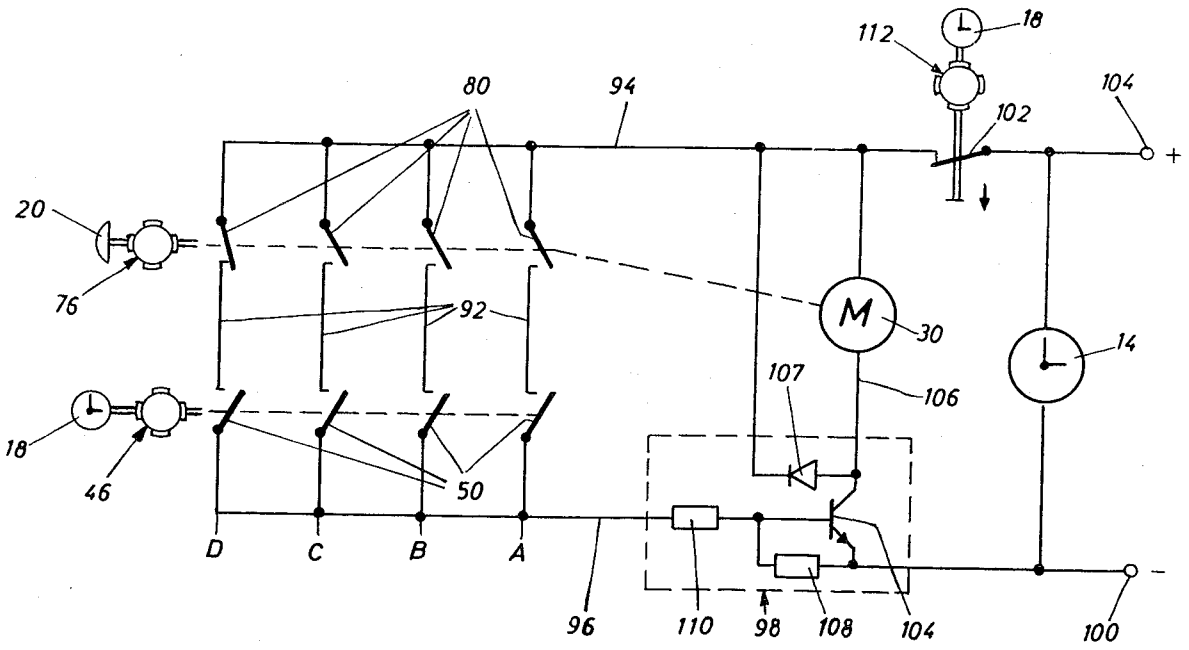
FIG. 7 shows a schematic circuit diagram of the electrical section for the clockwork illustrated in FIGS. 1 to 6.

Each pair of contact springs 52, 54 is connected through a pair of conductors 64, only the ends of which are visible in FIG. 1, to the circuit of the clockwork shown in FIG. 7.

The drive of the cam cylinder 46, which is mounted rotatably on the main plate 10 in the direction of the arrow 62, is effected by the movement 14 through the drive gear 18 and an intermediate gear 66 meshing with the drive gear 18 and which is supported rotatably on the main plate 10, which meshes with the drive gear 68 of a further intermediate gear 70 mounted rotatably on the main plate 10. The intermediate gear 70 is, in turn, in mesh with the drive gear 72 of the cam cylinder 46. The transmission ratios of this cam cylinder transmission are chosen so that the cam cylinder 46 executes exactly one revolution per hour.

With each of the cams 48 being mutually staggered at an angle of 90° in the axial direction of the cam cylinder 46, there is associated a pair of contact springs 52, 54, so that in each case, after the expiry of a quarter hour, one of the four contacts of the contact spring set 50 is closed and remain closed for a period determined by the cam length in the peripheral direction. In FIG. 1 only one pair of contact springs 52, 54 is visible, because the remaining three pairs of contact springs are located directly in front of or behind the pair of illustrated contact springs.

The switching-on period of the striking train 20 is determined by a second control element 74, which likewise includes a cam cylinder 76 having four cams 78 mutually laterally staggered and in the peripheral direction, and a set of contact springs 80. The set of contact springs 80 likewise possesses four pairs of contact springs 82, 83, which are supported by a common spring block 84. Again, of the pairs of contact springs 82, 83, only one is visible in FIG. 1. The cam cylinder 76 is mounted non-rotatably upon the shaft 28 of the striking train 20 and is therefore driven simultaneously therewith through the gear wheel 42 by the gear motor 30 in the direction of the arrow 86. The cams 78 each have a different length as measured in the peripheral direction of the cam cylinder 76, so that the pairs of spring contacts 82, 83 are respectively closed in a period corresponding to the cam length, as soon as the sensing section 88 of the contact springs 83 comes into abutment against the associated cam 78. Each pair of contact springs 82, 83 is connected through a pair of conductors 90 to the electric circuit of the clock shown in FIG. 7, only the end portions of the conductors 90 being illustrated in FIG. 1.

The relative extension of the cams 48 in the peripheral direction of the cam cylinder 46 is schematically illustrated in FIG. 4. The relative extension of the cams 78 in the peripheral direction of the cam cylinder 76 is illustrated schematically in FIG. 5. It will be seen particularly clearly from FIG. 5 that the individual cams 78 overlapped each other slightly in the peripheral direction.

From the electric circuit of the clockwork, illustrated in FIG. 7, it will be seen that one contact spring at a time of the contact spring set 50 is connected to one contact spring at a time of the contact of the contact spring set 80 associated in each case with the same quarter hour through a conductor 92. The two uppermost contacts designated A then correspond to the first quarter hour, the next contacts designated B correspond to the second quarter hour, those designated C to the third quarter hour and the contacts designated D to the full hour. They are each closed in order by the two cam cylinders 46 and 76 respectively in the above described manner in each case. The drive gear 18 and the striking train 20, which rotate conjointly with the cam cylinder 76, are also schematically indicated at the lower end of the circuit in FIG. 7. Whereas the drive of the cam cylinder 46 is effected through the drive gear 18 directly by the movement 14, the cam cylinder 76 is driven by the motor 30 in the above described manner.

The respectively associated contacts of the contact spring sets 50 and 80, which are mutually interconnected by the conductors 92, are in each case connected in parallel to two conductors 94 and 96. The conductor 96 is connected through a direct current amplifier 98 to the negative terminal 100 of a direct voltage source, not shown in detail, whereas the conductor 94 is connected through a contact 102 to the positive terminal 104 of the voltage source. The direct current amplifier 98 contains an npn-type transistor 104, the collector of which is directly connected by a conductor 106 to one connection of the gear motor 30. The other connection of the gear motor is connected to the conductor 94. For protection against harmful voltage peaks, the gear motor 30 is bridged by a blocking diode 107. A resistance 108 is placed between the emitter, connected to the negative terminal 100 of the voltage source, and the base of the transistor 104, and a resistance 110 is placed between the base of the transistor and the conductor 96.

The movement 14 further is connected to the terminals 100 and 104 of the voltage source.

Of the contacts of the contact spring set 80, one is closed at any time (in FIG. 7 the lower contact B for the full hour), since, according to FIG. 5, the cams 78 overlap each other in the peripheral direction. As soon as, shown in the position of FIG. 7, the hand mechanism and hence the drive wheel 18 reaches the full hour, the contact D of the contact spring set 50 is closed by the cam cylinder 46 and the striking train commences to run. The duration of the run of the striking train is determined by the length of the relevant cam 78 of the cam cylinder 76. After completion of the hour chime, the contact D of the contact spring set 80 opens, so that the striking train comes to a standstill. However, simultaneously, the contact A of the contact spring set 80 has already closed and the striking train thus has been set in readiness for the first quarter chime, which is tripped as soon as the corresponding cam 48 of the cam cylinder 46 closes the contact A of the contact spring set 50. This mode of actuation of the striking train is then cyclically continued in the case of the contacts B, C, D, A and so forth.

The gear motor 30 is only set in motion when two contacts of the two contact spring sets 50 and 80, which are connected together by a conductor 92, are simulatneously closed. By virtue of the direct current amplifier 98, only a minimum control current flows through the contact spring sets 50 and 80, representing approximately 1/100 of the current flowing through the gear motor 30, so that the contact spring sets can be constructed correspondingly thin and comparatively reaction-free. In view of the extremely small currents flowing through the contacts, the danger of burning of the contacts and any movement of the contacts associated therewith is practically entirely eliminated. The blocking diode 107 protects the contact sets against the substantial induction currents generated by the gear motor 30.

Due to the above-described mode of construction of the striking train control system, the striking train can also be synchronized in a particularly simple manner. The hands can be turned manually in any desired direction, for example through several hours, so that the hand mechanism comes out of step with the striking train. This means that the striking train may now chime incorrectly, until it becomes synchronized once more at the full hour with the hand mechanism. Due to the above-described circuit of the the two control sections 44 and 74, which is illustrated in FIG. 7, an electrical connection between two associated contacts A, B, etc. can only occur when the striking train aligns with the hand mechanism. Therefore, the striking train will not chime as long as the striking train is not synchronized with the hand mechanism. This occurs as soon as two associated contacts — i.e. contacts connected together by a conductor 92 — are simultaneously closed.

Figure 6:
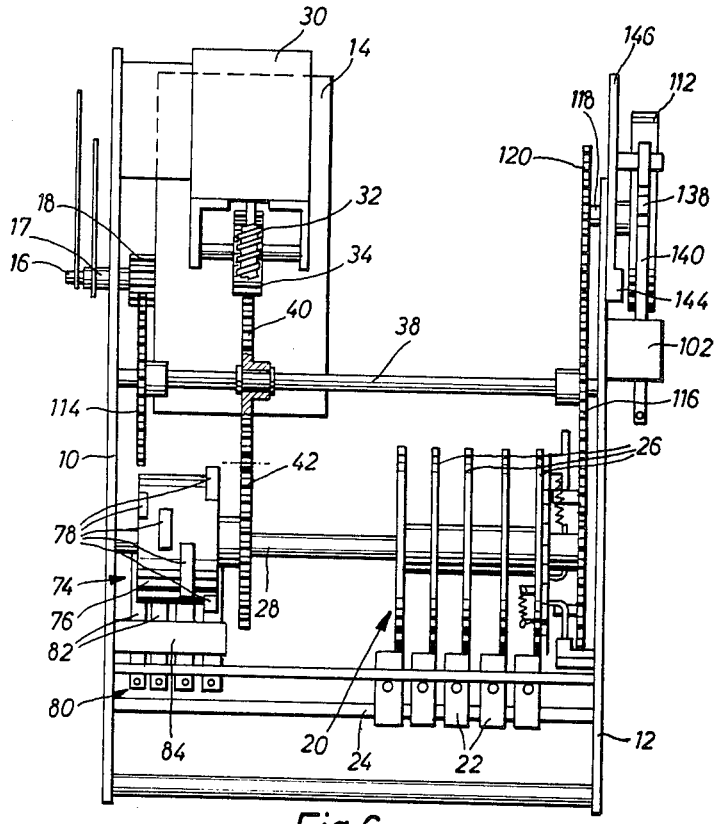
FIG. 6 shows a side elevational view, rotated through 90° with reference to FIG. 1, of the clockwork, viewed in the direction of the arrow VI in FIG. 1.

It is possible to switch off the striking train at night by means of the switch 102 illustrated in FIGS. 1, 6 and 7. The switch 102 is operable by a regulating wheel 112 which is supported rotatably on the rear plate 12 and is driven by the movement 14 through the drive gear 18, the intermediate gear 66, a gear wheel 114 in mesh with the intermediate gear 66 and fixed on the shaft 38, the shaft 38, a gear wheel 116 identical to the gear wheel 114 mounted on the other end of the shaft 38, and a gear wheel 120 in mesh with the gear wheel 116 and mounted with the regulating wheel 112 on a common shaft 118 supported in the plate 12, so that it executes exactly one revolution in 24 hours. As may be seen from FIGS. 1 to 3, the regulating wheel 112 has on a section of its circumference notches 122 on each of which a manually removable rider 124 is mounted. In the exemplary embodiment illustrated in FIG. 1 nine such riders 124 are positioned, whilst one notch 122 is left free. The width of the riders is chosen so that it coresponds in each case to the rotation of the regulating wheel 112 executed in 1 hour. Each notch 122 exhibits a stepped indentation 126 against which a correspondingly shaped stop 128 on the inside of each rider 124 comes into abutment, as may be seen from FIG. 3. In this position a lug 130 of each rider engages into a corresponding indentation 132 on a lateral face of the regulating wheel 112, so that the rider is firmly seated. It can however be removed manually from the regulating wheel in the radial direction, in which case the lug 130 moves elastically out of the indentation 132. The rider 124 can then be rotated through 180° about a radial axis and pushed back onto the notch 122. In this instance, the stop 128 comes into abutment with the higher portion 134 of the stepped indentation 126, so that the rider 124 is now seated somewhat further out in the radial direction than it is illustrated in FIGS. 1 and 3. In this case, the lug 130, considered as in FIG. 3, is present on the left-hand side of the regulating wheel 112 and engages into an indentation 136 extending further outwards in the radial direction on the regulating wheel 112. By this reversal through 180° the rider 124 projects outwards beyond the circumference of the regulating wheel 112. A sensing section 138 of the one contact spring 140 of the contact 102 slides upon this circumference of the regulating wheel. As long as the sensing section 138 is not deflected in the radial direction beyond the circumference of the regulating wheel 112, the contact 102 constituted by the contact springs 140 and 142 is closed. However, when the sensing section 138 is deflected by a rider 124 which is reversed in the manner described in the radial direction of the regulating wheel 112 — i.e., towards the left-hand side in FIG. 1 — the contact 102 is opened and the current supply to the gear motor 30 is thus interrupted, as may be seen from FIG. 7. In the illustrated embodiment, a maximum of 10 riders 124, each corresponding to one hour, can be reversed, so that the maximum night switching-off period of the striking train may be 10 hours. Naturally, regulating wheels with larger or smaller numbers of notches 122 and riders 124 may also be provided, as required. The exchange of the regulating wheel 112 can also be performed very simply in the above described manner if the regulating wheel engages by a projection into an axially extending indentation of the shaft 118 and the anchorage of the regulating wheel in the direction of rotation upon the shaft 118 is effected thereby.

The switch 102 may also be manually opened at any time through actuating a lever 146 which is pivotable about a pivot axis 144 on the rear plate 12. The sensing section 138 of the contact spring 104 is operable by the said lever 146 so that the contact is opened as soon as the lever 146 is pivoted out of the position of contact with the stop 148 shown in FIG. 1 into a position of contact with a second stop 150.

It should also be observed that the solution of the hour chime, known per se, in the striking train 20, and also the associated components are not described in detail here, since they are not necessary to an understanding of the invention.

Figure 8:
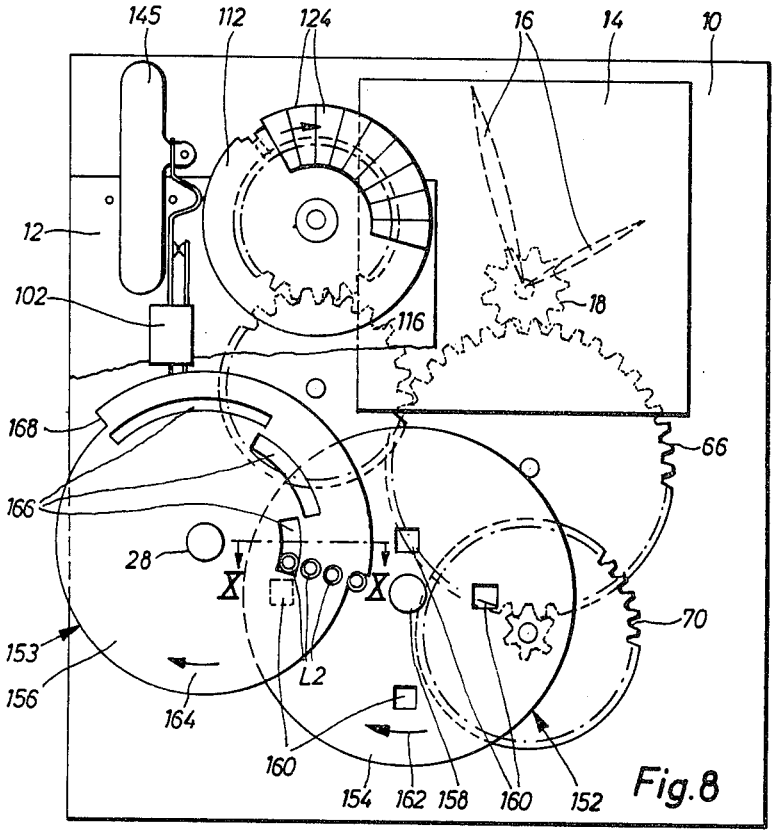
FIG. 8 shows an elevational view coresponding to FIG. 1 of a further embodiment of a large clockwork, the striking train of which is controllable by means of a contactless inductive sensing device.
Figure 10:
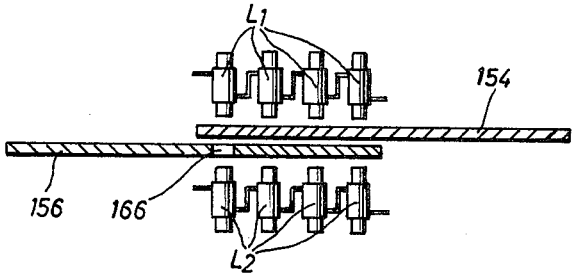
FIG. 10 shows a partial sectional view taken along line X—X in FIG. 8.
Figure 9:
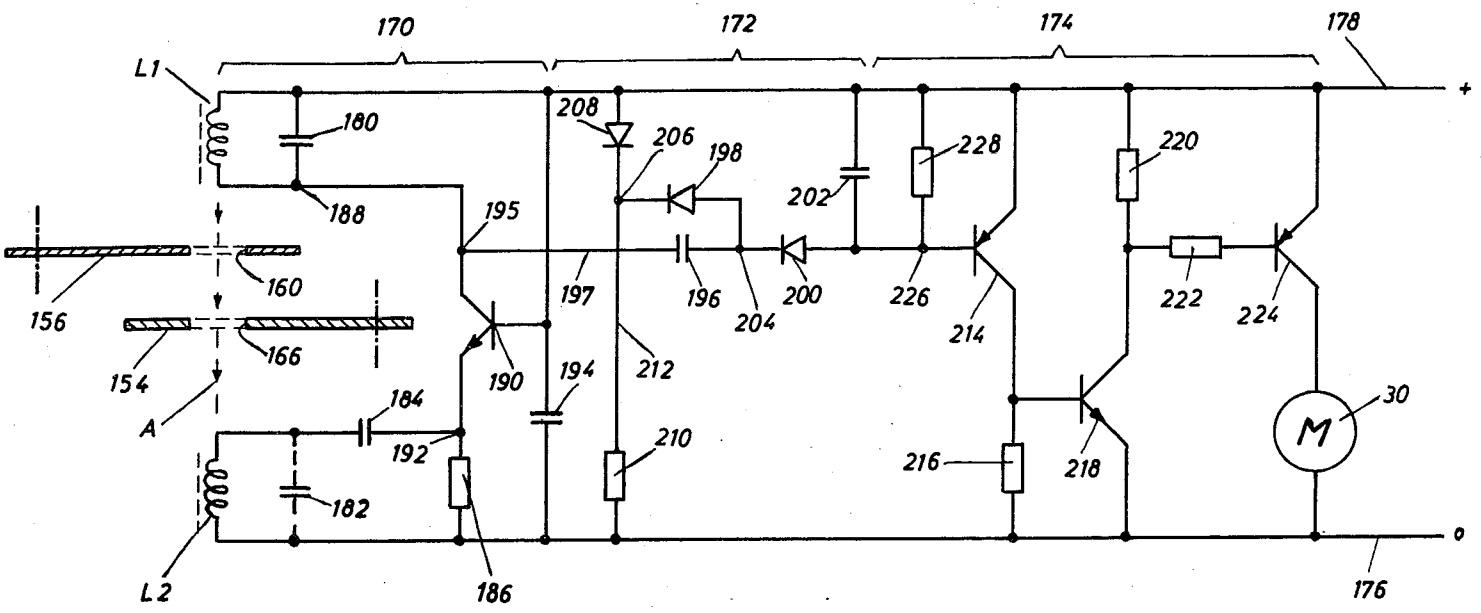
FIG. 9 shows a circuit diagram of the electrical section of the clockwork illustrated in FIG. 8.

In the exemplary embodiment illustrated in FIGS. 8 to 10, the two control elements 44 and 74 are replaced by contactless inductively operating controlled elements 152 and 153. Insofar as the remaining parts of the clockwork correspond to the parts of the exemplary embodiment illustrated in FIGS. 1 to 7, they are provided with the same reference numerals in FIG. 8 and need not be further described herein.

The control elements 152 and 153 each include a control wheel 154 or 156 mounted rotatably on the main plate 10, of which the control wheel 154 exhibits a driving gear 158 which is driven directly by the movement 14 through the intermediate gears 70 and 66 and the drive gear 18, and the control wheel 156 is mounted on the striking train shaft 28. The control element 152 corresponds therefore to the first control element 44, tripping the time of the quarter hour chime, of the above described exemplary embodiment, and the control element 153 corresponds to the second element 74 for detemining the duration of the quarter hour chime. For each quarter hour chime there is provided, in the control wheel 154, a square perforation 160, while the perforations 160 have progressively greater radial intervals from the axis of rotation of the control wheel 154. The individual perforations 160 are mutually staggered through 90° angles each time (referring to the graphic representation, FIG. 4 and FIG. 5).

The first control wheel 154 is partially overlapped by the second control wheel 156, which is set in rotation conjointly with the striking train by the gear motor 30 (see FIG. 6), not shown in FIG. 8. The direction of rotation of both control wheels 154 and 156, considered as in FIG. 8, is clockwise, as indicated by the arrows 162 and 164. For each of the first, second and third quarter hours, the control wheel 156 has a slit 166 oriented in the peripheral direction, and for the full hour it exhibits an edge recess 168 continuous over more than half its circumference. The slits and recesses 166 and 168 are mutually staggered in the peripheral direction and in the radial direction, but overlap one another slightly in the peripheral direction. The radial interval of the slits and recesses from the shaft 28 increases from the shortest slit 166 associated with the first quarter hour through the second somewhat longer slit 166 associated with the second quarter hour, and the even longer slit 166 associated with the third quarter hour, up to the long edge recess, in uniform stages (see also FIG. 5). These radial intervals of the slits 166 and of the edge recesses 168 from the rotary axis of the control wheel 154 corresponds to the radial intervals of the four perforations 160 from the rotary axis of the control wheel 156 (see also FIG. 4), so that the movement paths of the perforations 160 and 166 and of the edge recess 168 overlap at one point in each case. At this overlap point of the movement paths, there are arranged four inductive sensing elements associated with the four different radial intervals of the perforations or recesses, and each consisting of an inductance L1 arranged on the rear side of the control wheel 154 and of a second inductance L2 aligned with the latter and arranged on the front side of the control wheel 156. The inductances L1 on the one hand and the inductances L2 on the other hand are respectively connected in series. In each case an inductance L1 and the associated inductance L2 form a pair with a common field line axis, while the field line axis of any pair is always located in the region of a slit 166 or of the edge recess 168. In the illustration, FIG. 8, the slit 166 associated with the first quarter hour is just in the field line axis of the first pair of inductances L1 and L2 located outside on the left-hand side of FIGS. 8 and 10.

Each pair of inductances L1 and L2 is connected to the electric circuit for the striking train in the manner which may be seen from FIG. 9. The above mentioned field line axis connecting the two inductances is designated A in FIG. 9. The control circuit shown in FIG. 9 can be divided into three groups, namely into an oscillator exhibiting a sensing device 170, a rectifier stage 172 and a direct current amplifier 174. The circuit is supplied with zero potential through a distributing wire 176 and with direct voltage through a positive distributing wire 178. Of the inductances L1 and L2, only one pair is shown in FIG. 9, it being assumed that the circuit of the remaining pairs is similar. Each inductace L1 and L2 bridges a condenser 180 and 182. Furthermore, a resistance 186 is associated in parallel with the inductance L2 and a condenser 184. The connection point 188 between the inductance L1 and the condenser 180 is connected to the collector of an npn-type transistor 190, and the connection point 192 between the condenser 184 and the resistance 186 is connected to the emitter of the transistor 190. The base of the transistor is connected on the one hand to the distributing wire 178 and on the other hand, through a condenser 194, to the distributing wire 176. The described arrangement of inductances, condensers, resistances and the transistor 190 together constitutes an LC oscillator, the oscillator frequency of which is preferably chosen with values below 150 kHz, so that a minimum possible current consumption is sufficient for a reliable operation of the oscillator, and furthermore no problems of interference radiation arise. As indicated by a dash line for the relevant conductor, the condenser 182 may possibly be omitted.

The inductance L1 and the condenser 180 constitute the primary circuit of a band filter, the secondary circuit of which is constituted by the inductance L2, the condenser 182 and the condenser 184. The collector current of the transistor 190 flows directly through the primary circuit, whilst the emitter of the said transistor through the resistance 186, and the base of the transistor through the condenser 194, are each connected to zero potential. As soon as a perforation 160 of the first control wheel 154 comes to overlap sufficiently with a slit 166 of the edge recess 168 of the second control wheel 156, so that a passage slit with a specific minimum area is produced for the field line axis A, the LC oscillator 170 commences to oscillate stably. For this purpose it is necessary that the input resistance on the emitter side of the transistor 190 is kept small compared to the capacitive resistance of the condenser 184. By this means a pure phase feed back is obtained for the transistor 190 operating on base circuit, in the case of resonance between primary circuit and secondary circuit of the band filter. In this manner the advantage of the two circuit band filter, of making a sufficient feed back factor possible in the case of a relatively large interval of for example a few centimeters between the first inductance L1 and the second inductance L2, can be compared with the advantage of the transistor base circuit, of avoiding wild oscillations. For a highest possible limit frequency for the low collector currents of approximately 10 $\mu$ A in conjunction with capacitive modulation through the condenser 184, a pure phase feed back with optimum behavior on starting to oscillate can be achieved.

The maintenance of the phase condition between output signal and control signal is very essential for the obtention of an optimum oscillating behavior. A two circuit band filter, if used in the customary manner, would display a highly unfavorable phase behavior here, since fundamentally for the same tuning of primary and secondary circuit, the secondary voltage is displaced 90° in phase with reference to the primary voltage and to the collector current flowing in the primary circuit. By the mode of modulating the transistor 190 according to the invention, a further phase displacement of approximately 90° is produced between the control current and the secondary voltage, so that in conjunction with the negative current amplification (approximately − 1) of the transistor operating in base circuit, a pure phase feed back can actually be achieved in the case of resonance of the two circuits.

The alternating voltgage existing between the positive distributing wire 178 and the collector of the transistor 190 is tapped at the connection point 195 through a wire 197 and fed into the rectifier stage 172. A condenser 196 and a diode 200 are included in the wire 197, and the opposite pole of the diode 200 is connected through a condenser 202 to the distributing wire 178. The connection point 204 between condenser 196 and diode 200 is connected through a second diode 198 to the connection point 206 between a diode 208 and a resistance 210, which are included in a connecting wire 212 between the distributing wires 178 and 176.

The rectifier arrangement constituted by the diodes 198 and 200 rectifies the alternating voltage fed through the condenser 196, so that a rectified voltage of approximately 0.6 V is generated at the charging condenser 202.

For reliable functioning it is necessary to increase the effective voltage at the base of a transistor 214 by lowering the potential level when the rectified voltage appears by approximately 0.3 V, so that opening of the transistor 214 is still ensured even at half the battery voltage. In the absence of the said rectified voltage — i.e. when the transistor 190 is not oscillating, a bias voltage of approximately 0.6 V generated across the diode 208 by a resistance 210 is divided between the two diodes 198 and 200 at 0.15 V each and the resistance 228 placed in parallel with the base-emitter path of the transistor 214 with 0.3 V, so that in this state the transistor 214 still remains reliably blocked.

The connection point 226 between the diode 200 and the transistor 214 is connected through a resistance 228 to the positive distributing wire 178. The emitter of the transistor 214 is connected to the distributing wire 178, and the collector of the transistor is connected through a resistance 216 to the distributing wire 176 and also directly to the base of an npn-type transistor 218. The transistor 218 has its emitter connected to the distributing wire 176 and its collector connected through a resistance 220 to the positive distributing wire 178 and also through a resistance 222 to the base of a further pnp-type transistor 224, the collector of which is connected through the gear motor 30 to the distributing wire 176, and its emittor directly connected to the positive distributing wire 178.

As long as the field line axis A has no passage through the slits or perforations 166 and 160 of both control wheels 154 and 156, the oscillator 170 remains in the rest condition and all the transistors 214, 218 and 224 of the direct current amplifier 174 are blocked. The striking train is stationary. But as soon as the field line axis A has passage and consequently the oscillator 170 oscillates, the corresponding rectified voltage is built up at the charging condenser 202. This causes all the transistors of the direct current amplifier 174 to become conductive and the gear motor 30 runs until the rear edge of the slit 166 of the control wheel 154 cuts the field line axis A and the continuous slit width of the two apertures 166 and 160 becomes too small.

In the rest condition of the oscillator 170, the current consumption of the three transistors 214, 218 and 224 of the direct current amplifier 174 comprises only the collector residual currents of approximately 10 nanoamperes in all and is therefore negligibly small. This extremely small rest current has been rendered possible by the described circuit with transistors of different conductivity type, whereas in known direct current amplifiers transistors of the same conductivity type are used and therefore at least one of the transistors would have a rest current of more than 0.1 mA for the same practical application.

Figure 11:
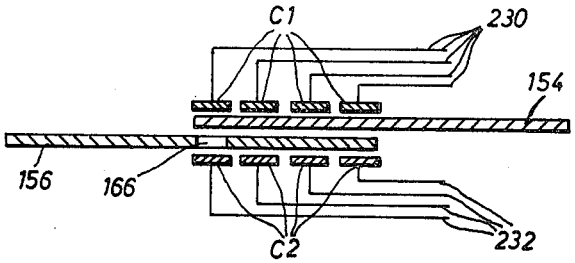
FIG. 11 shows a partial sectional view, similar to FIG. 10, through a further embodiment, which is provided with a capacitive sensing device.

Instead of the four inductances L1 or L2 which are, in each case, connected in series in the circuit shown in FIG. 9, in a further embodiment according to FIG. 11, a capacitive sensing device can be used, which respectively consists of four condenser plates C1 and C2. The condenser plates C1 and C2, in this instance, are arranged in the positions where the inductances L1 and L2 are arranged in the case of the embodiment according to FIG. 10. The oscillator 170 commences to oscillate only when a free passage exists between the two mutually associated condenser plates C1 and C2 of a pair of condenser plates by the overlapping of a perforation 160 with a slit 166 or with the edge recess 168. The individual condenser plates C1 and C2 are connected mutually in parallel through wires 230 and 232 respectively, within the primary and secondary circuits respectively of the band filter in the oscillator 170.

What is claimed is:

1. A clockwork comprising:

a clock movement for measuring time;

a striking train for sounding the time at preselected times;

an electric drive mechanism for driving said striking train;

control means for activating said drive mechanism at said preselected times and deactivating said drive, mechanism at the end of the striking period; said control means comprising:

a first wheel for selecting said preselected times, said first wheel being driven by said clock movement and having cut-outs radially spaced in staggered relationship such that each radial distance from the axis of said first wheel contains only one cut-out, said first wheel cut-outs being angularly spaced to correspond to said preselected times;

a second wheel for selecting the length of said striking period, said second wheel being driven by said drive mechanism and having cut-outs radially spaced in staggered relationship such that each radial distance from the axis of said second wheel contains only one cut-out, each of said second wheel cut-outs having a length in a peripheral direction corresponding to its respective said length of said striking period and each end of each of said second wheel cut-outs slightly angularly overlapping one end of another of said second wheel cut-outs;

said first and second wheels being mounted on parallel axes to mutually overlap in paired relationship the movement path of said cut-outs of said first and second wheels;

electrical sensing means including cooperating sensing elements located on opposite sides of said first and second wheels proximate said movement path overlaps; and drive circuit means responsive to said sensing elements to activate said drive mechanism when said paired cut-outs overlap and to deactivate said drive mechanism when said paired cut-outs do not overlap.

2. Clockwork according to claim 1, said control wheels being constituted of aluminum.

3. Clockwork according to claim 1, said sensing device comprising pairs of inductances associated at an overlapped position at respective movement paths, said inductances being separated by the control wheels and adapted to be coupled through said mutually overlapping cut-outs.

4. Clockwork according to claim 3, said pairs of inductances forming parts of an LC-oscillator, said oscillator containing a band filter constituted by said inductances, and a transistor operated in a base circuit capacitively coupled thereto.

5. Clockwork according to claim 4, a rectifier stage being connected to said oscillator; and a direct current amplifier having an input connected to said rectifier stage and an output connected to said striking train drive mechanism.

6. Clockwork according to claim 5, said rectifier stage comprising two diodes connected in series so as to form a voltage doubling circuit.

7. Clockwork according to claim 6, comprising a stabilized bias voltage of approximately −0.3 V being applied to the base-emitter path of the first transistor of the direct current amplifier by means of a voltage of approximately 0.15 V applied to each of the diodes of the rectifier stage, and a voltage of approximately −0.6 V being applied to a further diode connected oppositely to the said diodes.

8. Clockwork according to claim 5, said direct current amplifier containing three transistors connected in parallel, the collectors of the first two transistors being respectively connected to the base of the following transistor, and the conductivity type of consecutive transistors being complementary.

9. Clockwork according to claim 4, said LC-oscillator being tuned so as to oscillate only in the case of direct couplings between the pairs of inductances.

* * * * *